US007597543B2

(12) United States Patent
Narisako et al.

(10) Patent No.: US 7,597,543 B2
(45) Date of Patent: Oct. 6, 2009

(54) IMPELLER AND FLUID PUMP HAVING THE SAME

(75) Inventors: Hideki Narisako, Kariya (JP); Tadashi Hazama, Chita-gun (JP)

(73) Assignee: Denso Corporation, Kariya (JP)

( * ) Notice: Subject to any disclaimer, the term of this patent is extended or adjusted under 35 U.S.C. 154(b) by 514 days.

(21) Appl. No.: 11/594,112

(22) Filed: Nov. 8, 2006

(65) Prior Publication Data

US 2007/0104567 A1 May 10, 2007

(30) Foreign Application Priority Data

Nov. 8, 2005 (JP) ..... 2005-323292
Jan. 11, 2006 (JP) ..... 2006-003409

(51) Int. Cl.
*F04D 29/18* (2006.01)
*F04D 29/40* (2006.01)

(52) U.S. Cl. ..... 416/234; 416/237; 415/55.1; 415/224

(58) Field of Classification Search ..... 415/55.1, 415/224; 416/234, 237
See application file for complete search history.

(56) References Cited

U.S. PATENT DOCUMENTS 5,486,087 A 1/1996 Treiber et al.
6,113,363 A 9/2000 Talaski
6,132,185 A * 10/2000 Wilhelm ..... 417/423.15
6,439,833 B1 * 8/2002 Pickelman et al. ..... 415/55.1
6,454,520 B1 * 9/2002 Pickelman et al. ..... 415/55.1
2003/0118437 A1 6/2003 Takami et al.

OTHER PUBLICATIONS

Chinese Office Action dated Feb. 15, 2008 issued in counterpart Chinese Application 200610143938.4 with English translation.
KR Examination Report dated Sep. 10, 2007.
German Office Action dated Dec. 10, 2008 issued in corresponding German Application No. 10 2006 035 408.7-15, with English translation.

* cited by examiner

*Primary Examiner*—Ninh H Nguyen
(74) *Attorney, Agent, or Firm*—Nixon & Vanderhye, PC

(57) ABSTRACT

An impeller includes vane grooves arranged with respect to the rotative direction. At least the radially inner side of a back surface of each vane groove is radially outwardly inclined backwardly with respect to the rotative direction. The back surface has a radially inner end and a radially outer end, which are connected via a line segment. The line segment and a radius of the impeller define a backward inclining angle α therebetween. The back surface is inclined from a thickness center of the impeller toward each thickness-end of the impeller forwardly with respect to the rotative direction. The thickness-center and the thickness-end are connected via a line segment. The line segment and the thickness-center define a forward inclining angle β therebetween. The angle α, β satisfy the following relationships: $15° \leqq \alpha \leqq 30°$; $\beta \leqq 60°$; and $1 \leqq \beta/\alpha \leqq 4$.

11 Claims, 14 Drawing Sheets

IMPELLER AND FLUID PUMP HAVING THE SAME

CROSS REFERENCE TO RELATED APPLICATIONS

This application is based on and incorporates herein by reference Japanese Patent Applications No. 2005-323292 filed on Nov. 8, 2005 and No. 2006-3409 filed on Jan. 11, 2006.

FIELD OF THE INVENTION

The present invention relates to an impeller and a fluid pump having the impeller.

BACKGROUND OF THE INVENTION

For example, a fuel pump includes a disc-shaped impeller that has vane grooves arranged with respect to the rotative direction thereof. The vane grooves, which are adjacent to each other, are partitioned. The impeller rotates to pressurize fuel flowing through a pump passage defined along the vane grooves. It is required to enhance discharge pressure of a fuel pump for enhancing spray performance of fuel injected from an injection valve. Discharge pressure of a fuel pump can be enhanced by increasing electricity supplied to a motor portion of the fuel pump. However, energy consumption of the fuel pump may swell due to increasing electricity supply.

According to U.S. Pat. No. 6,113,363 (JP-A-2000-240582), inclining angle of a surface defining each vane groove is restricted in a pump portion of a fuel pump, so that the pump portion and the fuel pump are enhanced in efficiency.

According to U.S. Pat. No. 5,486,087 (JP-A-7-189975), a fuel pump includes a pump portion having an inlet and a pump passage (pressurizing passage) that define a flow passage therebetween. The cross section of the flow passage is gradually reduced from the inlet toward the pump passage so as to enhance efficiency of the pump portion. Discharge pressure of the fuel pump can be increased by enhancing the pump efficiency, while energy consumption of a motor portion is restricted.

In recent years, it is required to further enhance the pump efficiency corresponding to demand for increasing in fuel discharge pressure and/or discharge amount of fuel.

SUMMARY OF THE INVENTION

In view of the foregoing problems, it is an object of the present invention to produce an impeller with enhanced pump efficiency. It is another object of the present invention to produce a fluid pump having the impeller.

According to one aspect of the present invention, an impeller, which is rotatable in a fluid pump to pressurize fluid in a pump passage along a rotative direction of the impeller, includes a plurality of partition walls that is arranged along the rotative direction. Adjacent two of the plurality of partition walls defining a vane groove therebetween. Each partition wall has a back surface on a backside with respect to the rotative direction. The back surface has a radially inner side. At least the radially inner side of the back surface is radially outwardly inclined backwardly with respect to the rotative direction. The back surface has a radially inner end and a radially outer end, which are connected via a first line segment. The first line segment and a first straight line, which extends radially outwardly from the radially inner end along a radius of the impeller, define a backward inclining angle $\alpha$ therebetween. The impeller has a thickness-center and thickness-ends with respect to a thickness direction of the impeller. The back surface is inclined from the thickness-center toward both the thickness-ends forwardly with respect to the rotative direction. The thickness-center and each of the thickness-ends are connected via a second line segment. The second line segment and a second straight line, which extends from the thickness-center along the circumferential direction forwardly with respect of the rotative direction, define a forward inclining angle $\beta$ therebetween. The backward inclining angle $\alpha$ and the forward inclining angle $\beta$ satisfy the following relationships: $15° \leqq \alpha \leqq 30°$; $\beta \leqq 60°$; and $1 \leqq \beta/\alpha \leqq 4$.

Alternatively, according to another aspect of the present invention, a fluid pump includes a case member that has an inlet port and a pump passage. The fluid pump further includes an impeller that is rotatable in the case member. The impeller has a plurality of vane grooves along the pump passage extending substantially along a rotative direction. Each vane groove is defined by a back surface on a backside with respect to the rotative direction. At least a radially inner side of the back surface is inclined to a radially outer side backwardly with respect to the rotative direction. The back surface has a radially inner end and a radially outer end, which are connected via a first line segment. The first line segment is inclined relative to a straight line, which extends radially outwardly from the radially inner end along a radius of the impeller, backwardly with respect to the rotative direction. The impeller has a thickness-center with respect to a thickness direction of the impeller. At least an inlet side of the back surface on a side of the inlet port is inclined from the thickness-center toward the inlet port with respect to the thickness direction forwardly with respect to the rotative direction. The case member has a communication wall that defines a communication passage communicating the inlet port with the pump passage. The communication wall has an inlet-side end and a passage-side end that are connected via an inclining straight line, which is gradually elevated from the inlet port toward the pump passage. The inclining straight line and a second line segment, which extends from the thickness-center of the back surface to the inclining straight line through the inlet-side end of the back surface, define an angle $\epsilon$ forwardly with respect to the rotative direction. The angle $\epsilon$ satisfies the following relationship: $90° \leqq \epsilon \leqq 130°$.

Alternatively, according to another aspect of the present invention, an impeller, which is rotatable in a fluid pump having a pump passage extending along a rotative direction of the impeller, includes a plurality of partition walls that is arranged along the rotative direction. Adjacent two of the plurality of partition walls defines a vane groove therebetween. Each partition wall has a back surface on a backside with respect to the rotative direction. At least a radially inner side of the back surface is radially outwardly inclined backwardly with respect to the rotative direction. The back surface has a radially inner end and a radially outer end, which are connected via a first line segment defining a backward inclining angle $\alpha$ being an acute angle with respect to a radius of the impeller. The back surface is inclined from a thickness-center of the impeller toward both thickness-ends of the impeller forwardly with respect to the rotative direction. The thickness-center and each of the thickness-ends are connected via a second line segment, which defines a forward inclining angle $\beta$ being an acute angle with respect to a first straight line, which is tangent to a circumscribed circle of an outer circumferential periphery of the impeller. The backward inclining angle $\alpha$ and the forward inclining angle $\beta$ satisfy the following relationships: $15° \leqq \alpha \leqq 30°$; $\beta \leqq 60°$; and $1 \leqq \beta/\alpha \leqq 4$.

Alternatively, according to another aspect of the present invention, a fluid pump includes a case member that has an inlet port and a pump passage. The fluid pump further includes an impeller that is rotatable in the case member. The impeller has a plurality of vane grooves along the pump passage extending along a rotative direction of the impeller. Each vane groove is defined by a back surface on a backside with respect to the rotative direction. At least a radially inner side of the back surface is outwardly inclined backwardly with respect to the rotative direction. The back surface has a radially inner end and a radially outer end, which are connected via a first line segment, which defines a backward inclining angle $\alpha$ being an acute angle with respect to a radius of the impeller. The back surface on a side of the inlet port is inclined from a thickness-center of the impeller toward the inlet port forwardly with respect to the rotative direction. The case member has a communication wall that defines a communication passage communicating the inlet port with the pump passage. The communication wall has an inlet-side end and a passage-side end that are connected via an inclining straight line, which is gradually elevated from the inlet port toward the pump passage. The inclining straight line defines an angle $\epsilon$ being one of the right angle and an obtuse angle with respect to a second line segment, which extends from the thickness-center of the back surface to the inclining straight line through the inlet-side end of the back surface. The angle $\epsilon$ satisfies the following relationship: $90° \leqq \epsilon \leqq 130°$.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
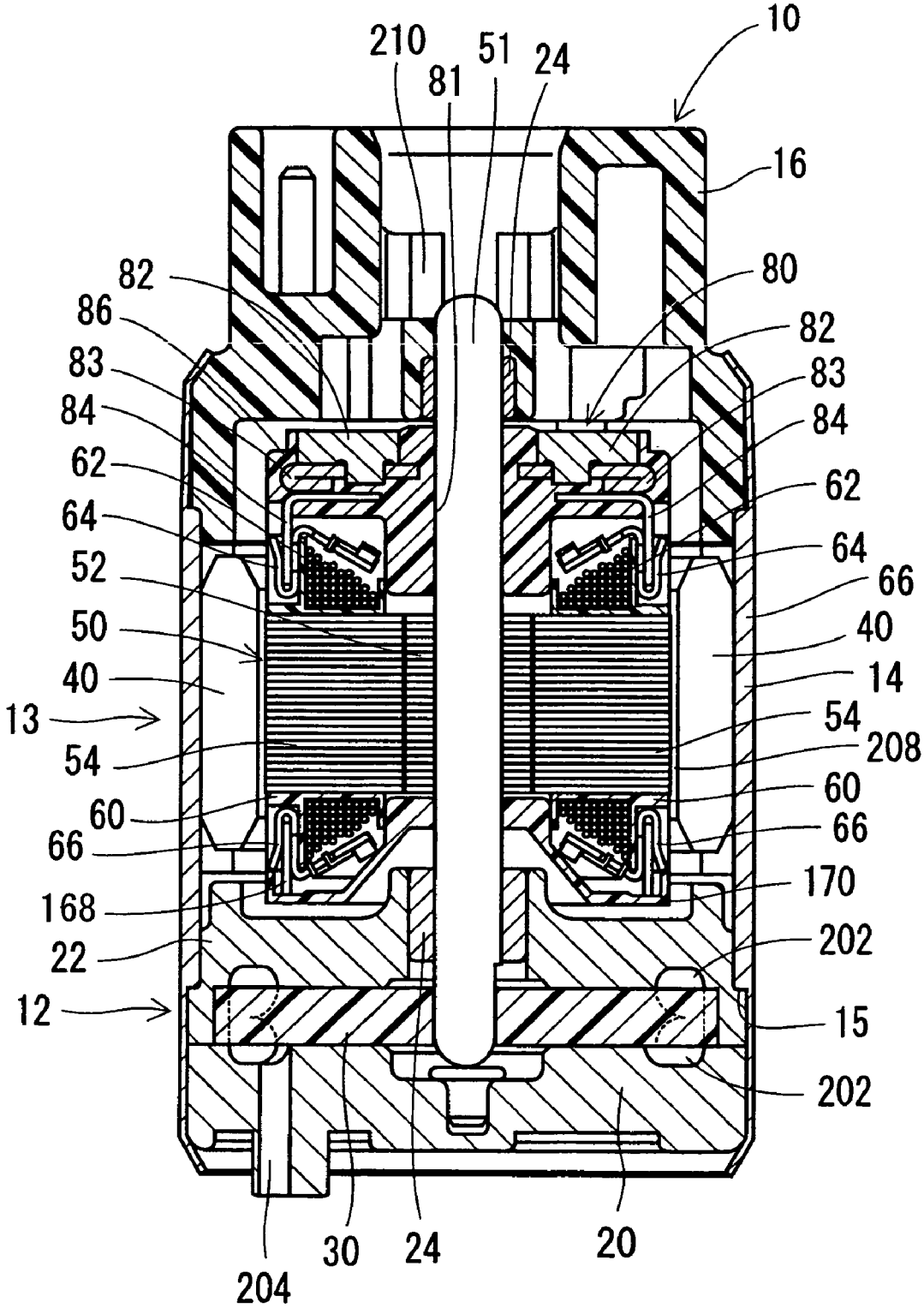
FIG. 1 is a sectional view showing a fuel pump according to a first embodiment.

As shown in FIG. 1, a fuel pump 10 is an in-tank type turbine pump that is provided to an interior of a fuel tank of a vehicle such as an automobile. The fuel pump 10 is a fluid pump supplies fuel from the fuel tank into a fuel injection valve (not shown). Outlet pressure of the fuel pump 10 is set between 0.25 to 1.0 MPa, for example. The fuel pump 10 discharges fuel over a range of 50 to 300 L/h, for example. Rotation speed of the fuel pump 10 is set between 4000 to 12000 rpm, for example.

The fuel pump 10 includes a pump portion 12 and a motor portion 13. The motor portion 13 operates the pump portion 12. A housing 14 accommodates both the pump portion 12 and the motor portion 13. The housing 14 is crimped and fixed to an end cover 16 and a pump case 20.

The pump portion 12 is a turbine pump that includes pump cases 20, 22 and an impeller 30. The pump case 22 is press-inserted into the housing 14 axially onto a step 15 of the housing 14. The pump cases 20, 22 serve as case members rotatably accommodating the impeller 30 as a rotor member. The pump cases 20, 22 and the impeller 30 define pump passages 202 (FIG. 3) in substantially C-shapes thereamong.

Figure 3A:
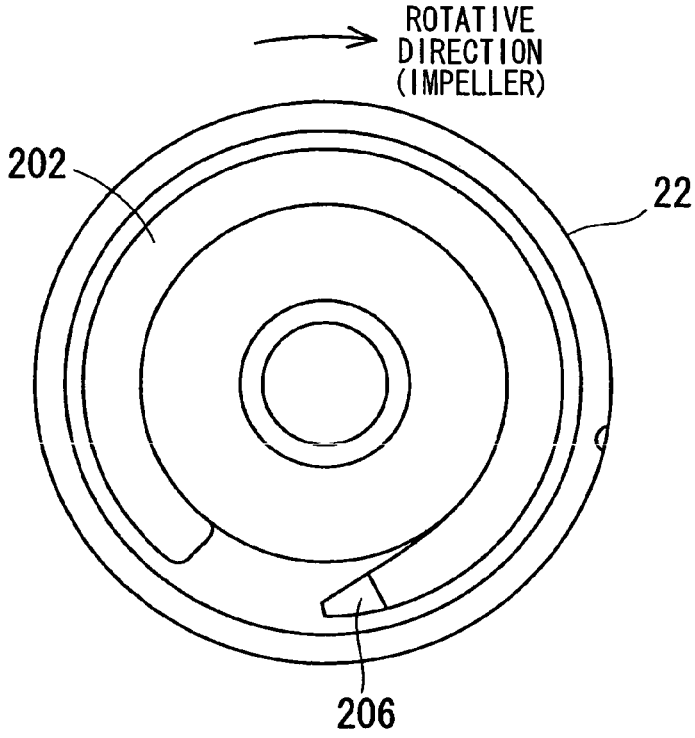
FIG. 3A is a schematic view showing a pump case of the fuel pump when being viewed from an outlet side.
Figure 3B:
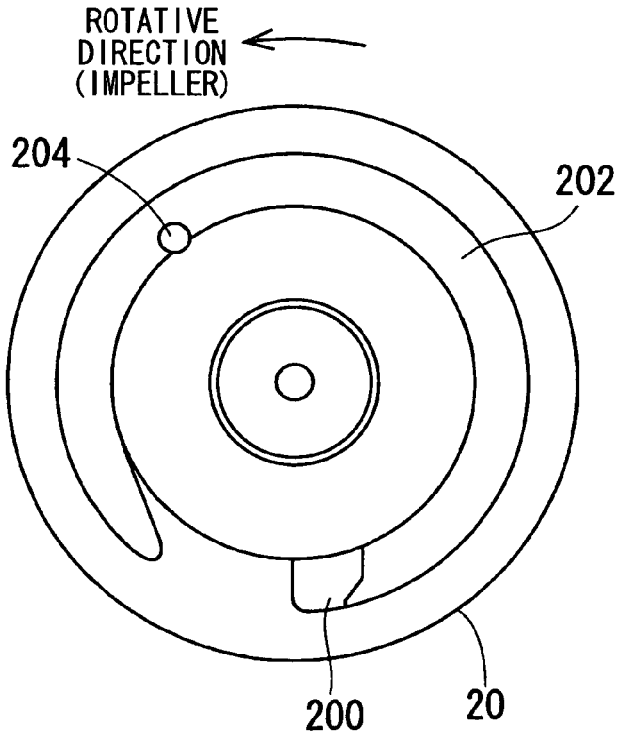
FIG. 3B is a schematic view showing the pump case when being viewed from the inlet side.
Figure 4A:
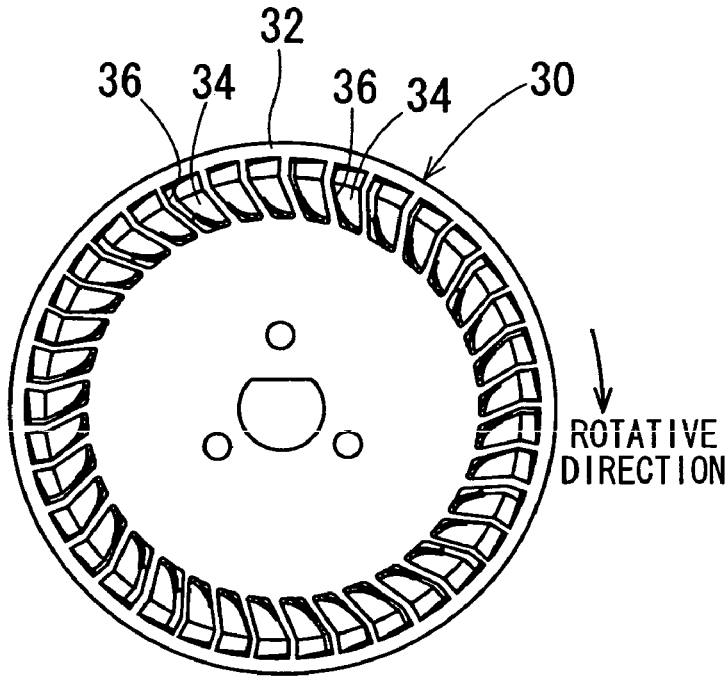
FIGS. 4A, 4B are front views showing the impeller when being viewed from the inlet side.
Figure 4B:
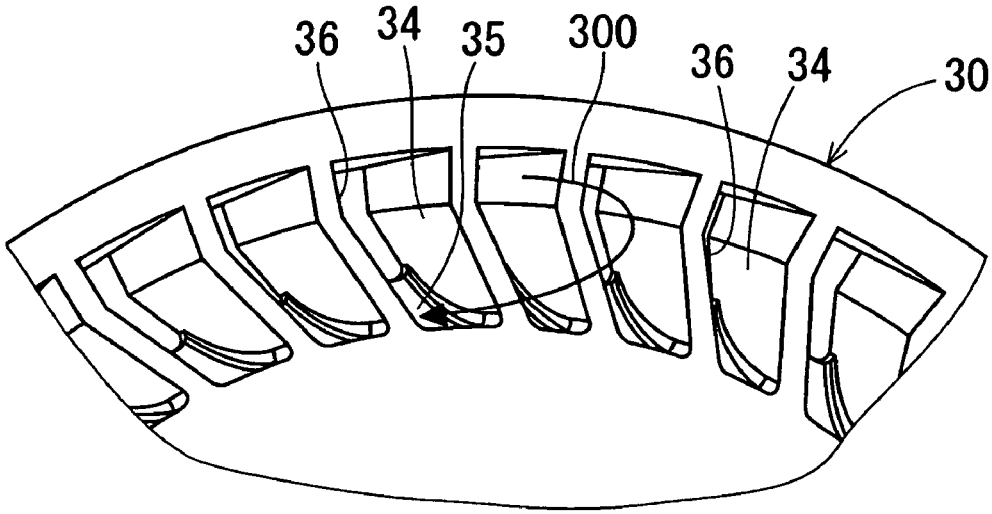

As shown in FIGS. 4A, 4B, the impeller 30 is in a substantially circular shape having an outer circumferential periphery, to which multiple vane grooves 36 are provided. The vane grooves 36 are arranged along the rotative direction of the impeller 30. The vane grooves 36, which are circumferentially adjacent to each other, are nonuniformly spaced. The vane grooves 36 are arranged at irregular pitch with respect to the rotative direction. The impeller 30 rotates together with a shaft 51 in conjunction with rotation of an armature 50, so that fuel flows from a radially outer side of one of the vane grooves 36 into a pump passage 202. The fuel flows from the pump passage 202 into a radially inner side of another vane groove 36, which is on a backside of the one of the vane grooves 36 with respect to the rotative direction. Thus, fuel forms a swirl flow 300 by repeating flowing out of the one of the vane grooves 36 and flowing into the other vane groove 36. The fuel forming the swirl flow 300 is pressurized through the pump passage 202. Fuel is drawn through an inlet port 200 (FIG. 3), which is provided to the pump case 20, by rotation of the impeller 30. The drawn fuel is pressurized through the pump passage 202 by rotation of the impeller 30, thereby being press-fed toward the motor portion 13 through an outlet port 206 (FIG. 3), which is provided to the pump case 22. The fuel press-fed toward the motor portion 13 is supplied to an engine through an outlet port 210, which is provided to the end cover 16, after passing through a fuel passage 208 defined between permanent magnets 40 and the armature 50. The pump case 20 has a vent hole 204 (FIG. 3). Vapor contained in fuel flowing through the pump passage 202 is vent to the outside of the fuel pump 10 through the vent hole 204.

Each of the permanent magnets 40 is in a substantially quadrant arch shape. Four permanent magnets 40 are circumferentially arranged along the inner circumferential periphery of the housing 14. The permanent magnets 40 define four magnetic poles, which are different from each other with respect to the rotative direction of the impeller 30.

The armature 50 has an end, which is on the side of the impeller 30, being covered with a resin cover 170, so that resistance against rotation of the armature 50 is reduced. The armature 50 has the other end, which on the opposite side of the impeller 30. The other end of the armature 50 is provided with a commutator 80. The shaft 51 serves as a rotation axis of the armature 50. The shaft 51 is rotatably supported by bearings 24, which are accommodated by the end cover 16 and the pump case 20.

The armature 50 includes a center core 52 in the rotation center thereof. The shaft 51 is press-inserted into the center core 52, which is in a cylindrical shape being substantially hexagonal in cross section. Six magnetic pole cores 54 are provided to the outer circumferential periphery of the center core 52, and are arranged with respect to the rotative direction. The six magnetic pole cores 54 are fitted to the center core 52. Each of the six magnetic pole cores 54 has the outer circumferential periphery, to which a bobbin 60 is fitted. The bobbin 60 is formed of electrically insulative resin. Winding is provided concentrically around the outer periphery of the bobbin 60, so that a coil 62 is constructed.

Each of the coils 62 has an end, which is on the side of the commutator 80, being electrically connected with each of coil terminals 64. Each of the coil terminals 64 corresponds to the rotative position of each of the coils 62. The coil terminals 64 fit and electrically connect with terminals 84 of the commutator 80. Each of the coils 62 has the other end on the opposite side of the commutator 80. The other end of each of the coils 62, on the side of the impeller 30, electrically connects with each of coil terminals 66. Six coil terminals 66 electrically connect with substantially annular terminals 168.

The commutator 80 is integrally formed, and has a cassette-type structure. The commutator 80 is assembled to the armature 50 by inserting the shaft 51 into a through hole 81 of the commutator 80 in a condition where the shaft 51 is press-inserted into the center core 52. In this condition, the terminals 84, which protrude from the commutator 80 toward the armature 50, are respectively fitted to the coil terminals 64 of the armature 50, thereby being electrically connected respectively with the coil terminals 64.

The commutator 80 includes six segments 82 that are arranged with respect to the rotative direction. The six segments 82 are formed of carbon, for example. The segments 82 are electrically insulated from each other via air gaps and/or electrically insulative resin 86.

Each of the segments 82 electrically connects with each of the terminals 84 via each of intermediate terminals 83. The commutator 80 is integrally formed by insert-molding the segments 82, the intermediate terminals 83, and the terminals 84 in the electrically insulative resin 86. Each of the segments 82 has a sliding surface, on which a brush (not shown) slides. The sliding surface of each segment 82 is exposed from the electrically insulative resin 86. The commutator 80 rotates together with the armature 50, so that each of the segments 82 sequentially comes into contact with the brush. The commutator 80 rotates and comes into contact with the brush, so that electricity supplied to the coils 62 is rectified. The permanent magnets 40, the armature 50, the commutator 80, and the unillustrated brush construct a direct-current motor.

Next, the structure of the impeller 30 is described.

Figure 2A:
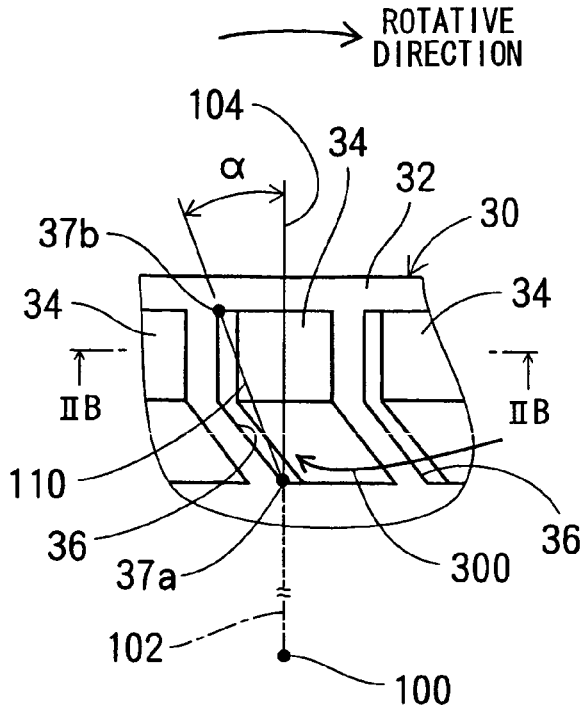
FIG. 2A is a schematic view showing vane grooves of an impeller of the fuel pump when being viewed from an inlet side.
Figure 2B:
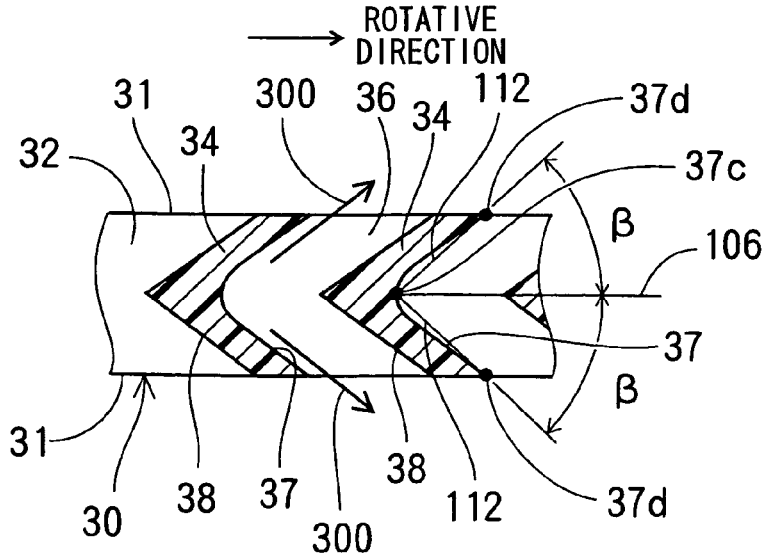
FIG. 2B is a sectional view taken along the line IIB-IIB in FIG. 2A.
Figure 5:
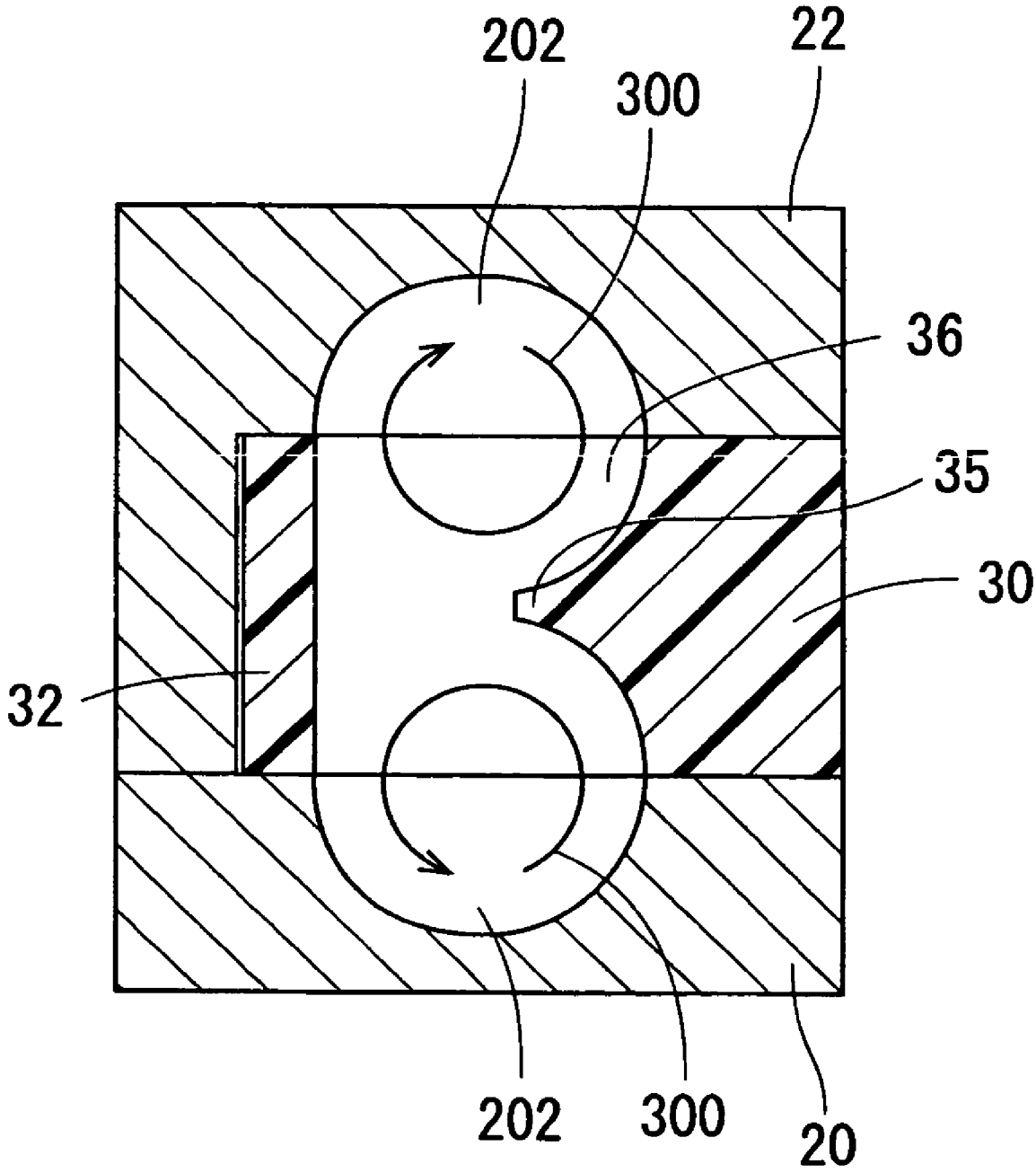
FIG. 5 is a sectional view showing a pump passage of the fuel pump.

The impeller 30 is integrally formed of resin to be in a substantially disc-shape. As shown in FIGS. 4A, 4B, the impeller 30 has the outer circumferential periphery that is surrounded by an annular portion 32. The annular portion 32 has the inner circumferential periphery, to which vane grooves 36 are provided. As shown in FIG. 2B, the vane grooves 36, which are adjacent to each other with respect to the rotative direction, are partitioned by a partition wall 34. The impeller 30 has the thickness-center 37*c* (FIG. 2B) with respect to the thickness direction of the impeller 30. The impeller 30 has the thickness-end surfaces 31 with respect to the thickness direction of the impeller 30. The partition wall 34 extends from substantially the thickness-center 37*c* of the impeller 30 toward both the thickness-end surfaces 31. The partition wall 34 is inclined forwardly with respect of the rotative direction such that the partition wall 34 forms a substantially V-shape. As shown in FIG. 5, a partition wall 35 radially outwardly protrudes from the radially inner side of the vane groove 36. The partition wall 35 partially partitions the radially inner side of the vane groove 36. The vane groove 36 communicates with each other with respect to the axial direction of the rotation axis on the radially outer side of the partition wall 35. Fuel flows from the pump passages 202 on the axially both sides into the vane grooves 36, and the fuel forms the swirl flow 300 along the partition wall 35. The swirl flow 300 oppositely rotates on axially both sides with respect to the partition wall 35.

As shown in FIG. 2B, the vane groove 36 has a back surface 37, which is located on the backside with respect to the rotative direction. At least the radially inner side of the back surface 37 is inclined from the radially inner side to the radially outer side backwardly with respect to the rotative direction. The back surface 37 of the vane groove 36 has a radially inner end 37*a* and a radially outer end 37*b*, which are connected via a line segment 110. A straight line 104 extends radially outwardly from the radially inner end 37*a* along the radius 102 of the impeller 30. The line segment 110 and the straight line 104 define a backward inclining angle $\alpha$ therebetween. The backward inclining angle $\alpha$ satisfies the following relationship: $15° \leqq \alpha \leqq 30°$. In FIG. 2A, the reference numeral 100 denotes the rotation axis of the impeller 30.

When the backward inclining angle $\alpha$ is set to be less than 15°, i.e., $\alpha \leqq 15°$, the swirl flow 300 may collide against the back surface 37 at a large angle, instead of flowing into the vane groove 36 along the back surface 37. This collision of the swirl flow 300 applies force to the impeller 30 oppositely to the rotative direction of the impeller 30. Consequently, the force due to the collision disturbs rotation of the impeller 30. When the backward inclining angle $\alpha$ is set to be greater than 30°, i.e., $\alpha > 30°$, the back surface 37 is excessively inclined backwardly with respect to the swirl flow 300, which flows into the vane groove 36, relative to the rotative direction. Accordingly, the swirl flow 300 may be peeled when the swirl flow 300 enters into the vane groove 36. Consequently, resistance becomes large when the swirl flow 300 enters into the vane groove 36.

Figure 6A:
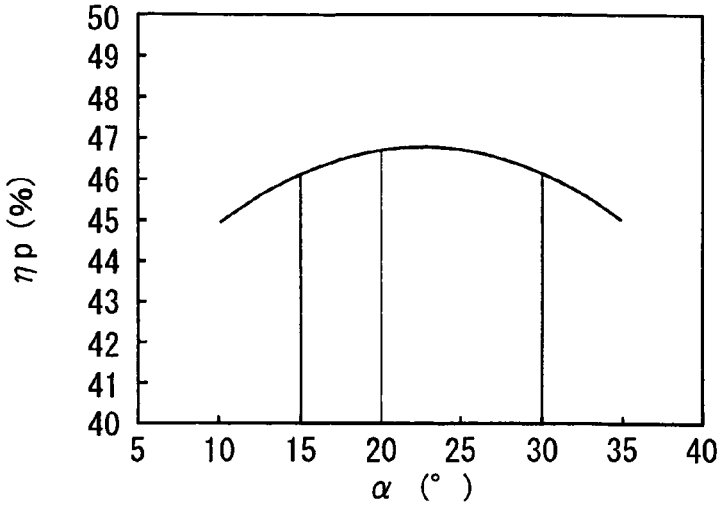
FIG. 6A is a graph showing a relationship between forward inclining angle $\alpha$ and pump efficiency.

Therefore, in the first embodiment, the backward inclining angle $\alpha$ is defined to satisfy the relationship of $15° \leqq \alpha \leqq 30°$. Thus, the swirl flow 300 smoothly flows into the vane groove 36, and resistance is reduced when the swirl flow 300 flows into the vane groove 36. As shown in FIG. 6A, pump efficiency ηp is maintained around the maximum value thereof in the range of 15°≦α≦30°. The backward inclining angle α preferably satisfies the following relationship: 20°≦α. That is, the backward inclining angle α is preferably set to be equal to or greater than 20°.

Here, efficiency η of the fuel pump 10 is calculated by multiplying motor efficiency ηm by the pump efficiency ηp. As the pump efficiency ηp increases, the efficiency η of the fuel pump 10 is enhanced.

The motor efficiency ηm is calculated by the following formula: ηm=(T×N)/(I×V). The pump efficiency ηp is calculated by the following formula: ηp=(P×Q)/(T×N). In the above formulas, I denotes electricity supplied to the motor portion 13, V denotes voltage applied to the motor portion 13, T denotes torque produced by the motor portion 13, and P, Q respectively denotes pressure and the amount of fuel discharged from the fuel pump 10. The efficiency η of the fuel pump 10 is calculated by multiplying the motor efficiency ηm by the pump efficiency ηp. That is, the efficiency η of the fuel pump 10 is calculated by the following formula: η=(P×Q)/(I×V). As the pump efficiency ηp is enhanced, the pressure or the amount of fuel discharged from the fuel pump 10 can be enhanced, without increasing energy consumption of the fuel pump 10.

As referred to FIG. 2B, the back surface 37 of the vane groove 36 is inclined from the thickness-center 37*c* toward both the thickness-end surfaces 31 forwardly with respect of the rotative direction. That is, the back surface 37 extends from the thickness-center 37*c* toward both the thickness-end surfaces 31 such that the back surface 37 forms a substantially V-shape. The back surface 37 has thickness-ends 37*d* with respect to the thickness direction of the impeller 30. The thickness-center 37*c* and each of the thickness-ends 37*d* are connected via a line segment 112. A straight line 106 extends from the thickness-center 37*c* along the circumferential direction forwardly with respect of the rotative direction. The line segment 112 and the straight line 106 define a forward inclining angle β therebetween. The forward inclining angle β satisfies the following relationship: β≦60°. The straight line 106 is perpendicular to the rotation axis 100.

When the swirl flow 300 moves out of the vane groove 36, the swirl flow 300 receives a component of energy from the vane groove 36 forwardly with respect to the rotative direction. When the forward inclining angle β is set to be greater than 60°, i.e., β>60°, the component of energy forwardly applied from the vane groove 36 to the swirl flow 300 becomes small. Accordingly, a pitch of the swirl flow 300 with respect to the rotative direction becomes large. Consequently, when the swirl flow 300 moves out of one vane groove 36 and enters into subsequent vane groove 36, which is on the backside of the one vane groove 36 with respect to the rotative direction, the interval between the one vane groove 36 and the subsequent vane groove 36 becomes large. That is, the number of entrance into and exit from the vane grooves 36 decreases while the swirl flow 300 passes through the pump passage 202. Accordingly, fuel cannot be sufficiently pressurized.

Figure 6B:
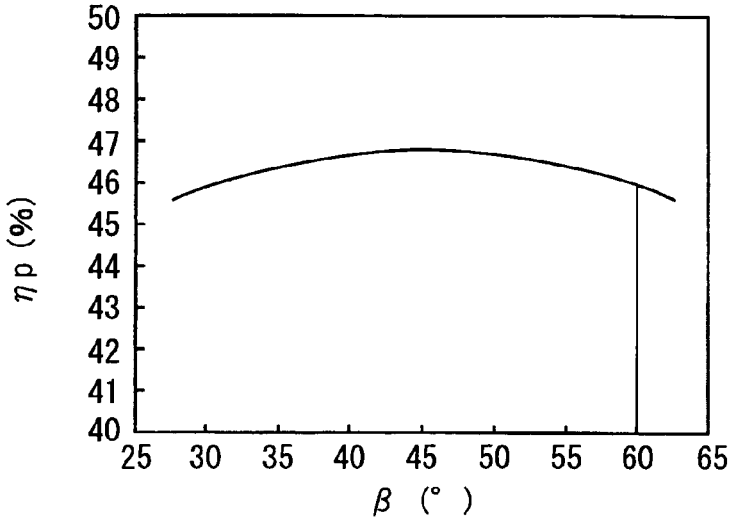
FIG. 6B is a graph showing a relationship between backward inclining angle $\beta$ and the pump efficiency.

Therefore, in the first embodiment, the forward inclining angle β is set to satisfy the relationship of β≦60°, so that the component of energy, which is applied from the vane groove 36 to the swirl flow 300 forwardly with respect to the rotative direction when the swirl flow 300 moves out of the vane groove 36, becomes large. Thus, the pitch of the swirl flow 300 with respect to the rotative direction becomes small. Consequently, the number of entrance into and exit from the vane grooves 36 increases while the swirl flow 300 passes through the pump passage 202. Therefore, efficiency of pressurizing fuel can be enhanced. Thus, as shown in FIG. 6B, the pump efficiency ηp is maintained around the maximum value thereof in the range of β≦60°.

When the forward inclining angle β is excessively small or excessively large with respect to the backward inclining angle α, the swirl flow 300, which moves out of the vane groove 36 along the back surface 37 at the forward inclining angle β, cannot smoothly flow into the back surface 37 of the vane groove 36 inclined at the backward inclining angle α.

Figure 6C:
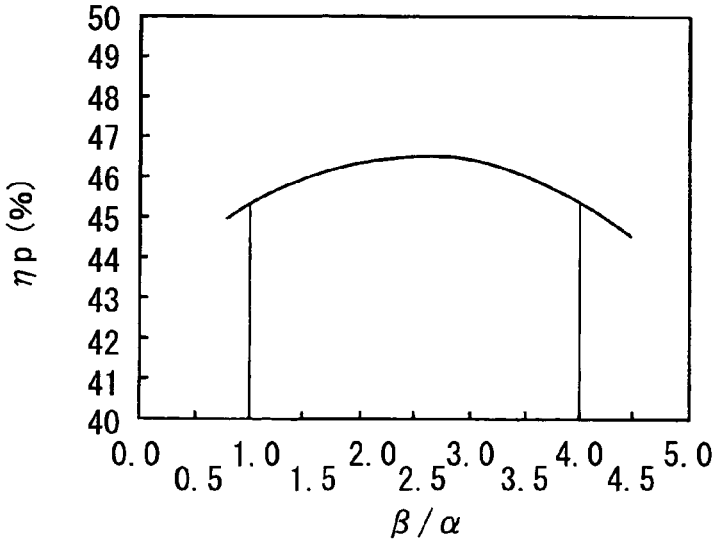
FIG. 6C is a graph showing a relationship between $\beta/\alpha$ and the pump efficiency.

Therefore, in the first embodiment, the backward inclining angle α and the forward inclining angle β are set to satisfy the following relationship of 1≦β/α≦4, such that fuel smoothly flows into the vane groove 36 in the ranges of 15°≦α≦30° and β≦60°. Thus, as shown in FIG. 6C, the pump efficiency ηp is maintained around the maximum value thereof in the range of 1≦β/α≦4.

In the first embodiment, the vane groove 36 has a front surface 38 on the front side with respect to the rotative direction. The front surface 38 extends from the thickness-center 37*c* toward both the thickness-end surfaces 31 such that the front surface 38 forms a substantially V-shape, similarly to the back surface 37. In this structure, the shape of the back surface 37 and the shape of the front surface 38 are substantially the same, so that a flow amount of fuel flowing out of the vane groove 36 and a flow amount of the fuel flowing into the vane groove 36 are substantially uniformed. Consequently, efficiency of pressurizing fuel can be enhanced.

In addition, in the first embodiment, the annular portion 32 surrounds the radially outer side of the vane grooves 36, and the outer circumferential periphery of the impeller 30 does not have a pump passage. Fuel is pressurized through the pump passage 202, and the pressurized fuel generates differential pressure with respect to the rotative direction. In this structure, the differential pressure is not directly applied radially to the impeller 30. Thus, force applied to the impeller 30 with respect to the radial direction is reduced. Thus, the rotation center of the impeller 30 can be restricted from being misaligned, so that the impeller 30 can smoothly rotate.

Second, Third, Fourth, and Fifth Embodiments

FIG. 7, FIG. 8, FIG. 9, and FIG. 10 respectively depict the second, third, fourth, and fifth embodiments. The structure of the fuel pump having each impeller of the second to fifth embodiments is substantially the same as that of the first embodiment.

In the second, third, fourth, and fifth embodiments, vane grooves 120, 130, 140, and 150 respectively have back surfaces 121, 131, 141, and 151 on the backside with respect to the rotative direction, and at least the radially inner side of each of the back surfaces 121, 131, 141, and 151 is inclined from the radially inner side to the radially outer side with respect to the rotative direction, similarly to the first embodiment. Each of the back surfaces 121, 131, 141, and 151 has corresponding one of radially inner ends 121*a*, 131*a*, 141*a*, and 151*a* and corresponding one of radially outer ends 121*b*, 131*b*, 141*b*, and 151*b*. Each of the radially inner ends 121*a*, 131*a*, 141*a*, and 151*a* and corresponding one of radially outer ends 121*b*, 131*b*, 141*b*, and 151*b* are connected via a line segment 110. A straight line 104 extends radially outwardly from each of the radially inner ends 121*a*, 131*a*, 141*a*, and 151*a* along the radius 102 of the impeller 30. The line segment 110 and the straight line 104 define a backward inclining angle α therebetween. The backward inclining angle α satisfies the following relationship: 15°≦α≦30°.

The forward inclining angle β of each of the back surfaces 121, 131, 141, and 151 is set to satisfy the relationship of $\beta \leqq 60°$, similarly to the first embodiment. Furthermore, the backward inclining angle α and the forward inclining angle β are set to satisfy the relationship of $1 \leqq \beta/\alpha \leqq 4$.

Figure 7:
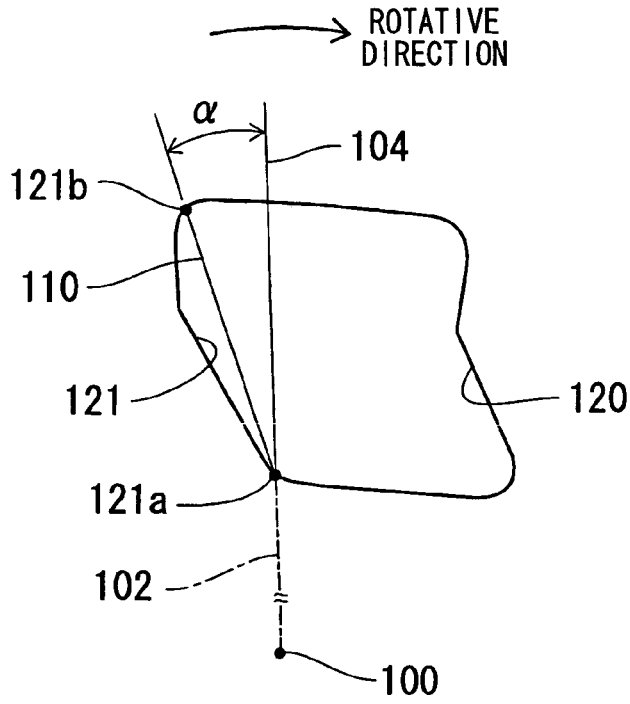
FIG. 7 is a schematic view showing a vane groove according to a second embodiment.

As shown in FIG. 7, in the second embodiment, the vane groove 120 has four corners each being in a substantially arc shape. In this structure, each of the radially inner ends 121*a* and the radially outer end 121*b* substantially defines the center of the arc of the corresponding corner.

Figure 8:
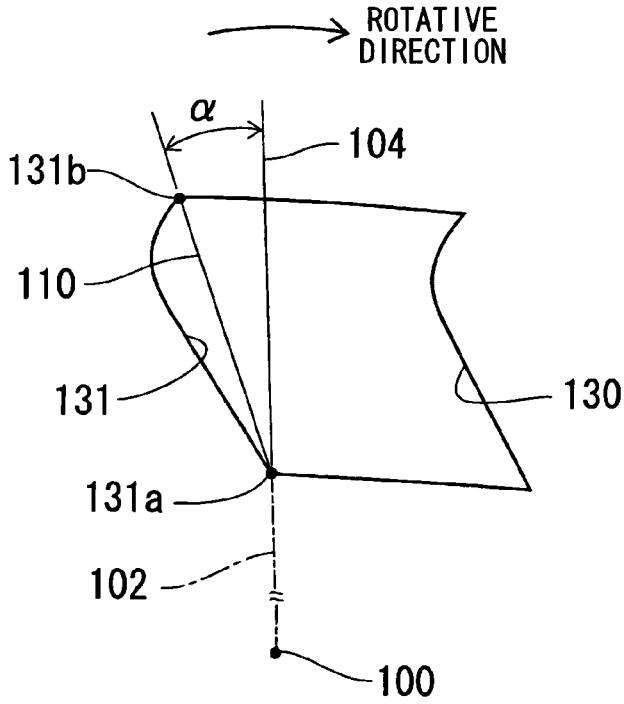
FIG. 8 is a schematic view showing a vane groove according to a third embodiment.

As shown in FIG. 8, in the third embodiment, the radially outer side of the back surface 131 is inclined toward the radially outer end forwardly with respect to the rotative direction in the vane groove 130. The radially inner side of the back surface 131 and the radially outer side of the back surface 131 define a smooth curved surface therebetween.

Figure 9:
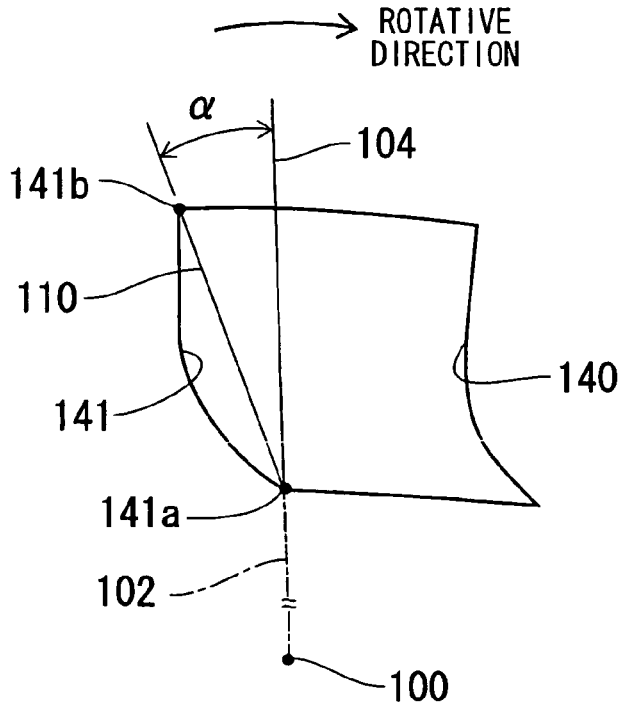
FIG. 9 is a schematic view showing a vane groove according to a fourth embodiment.

As shown in FIG. 9, in the fourth embodiment, the radially outer side of the back surface 141 of the vane groove 140 outwardly extends generally along the straight line 104. The radially inner side of the back surface 141 and the radially outer side of the back surface 141 define a smooth curved surface therebetween.

Figure 10:
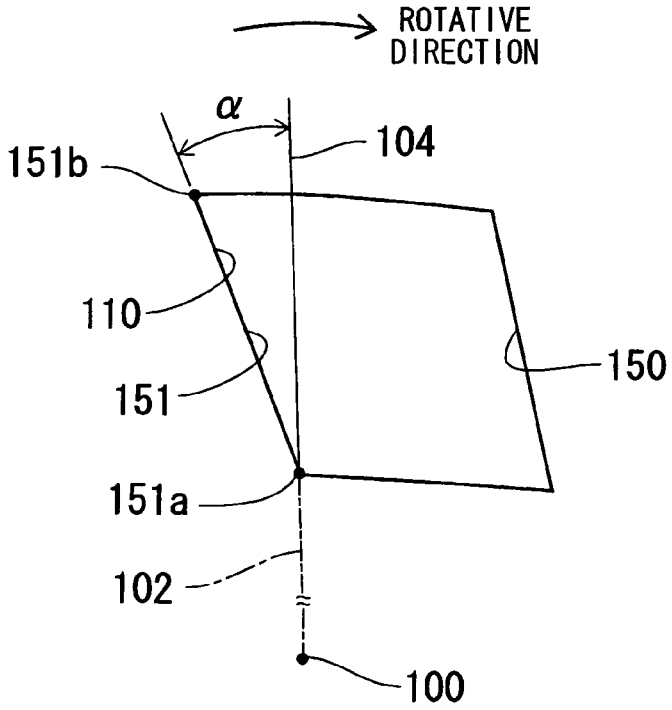
FIG. 10 is a schematic view showing a vane groove according to a fifth embodiment.

As shown in FIG. 10, in the fifth embodiment, the back surface 151 of the vane groove 150 defines a substantially flat surface.

Sixth Embodiment

Figure 11:
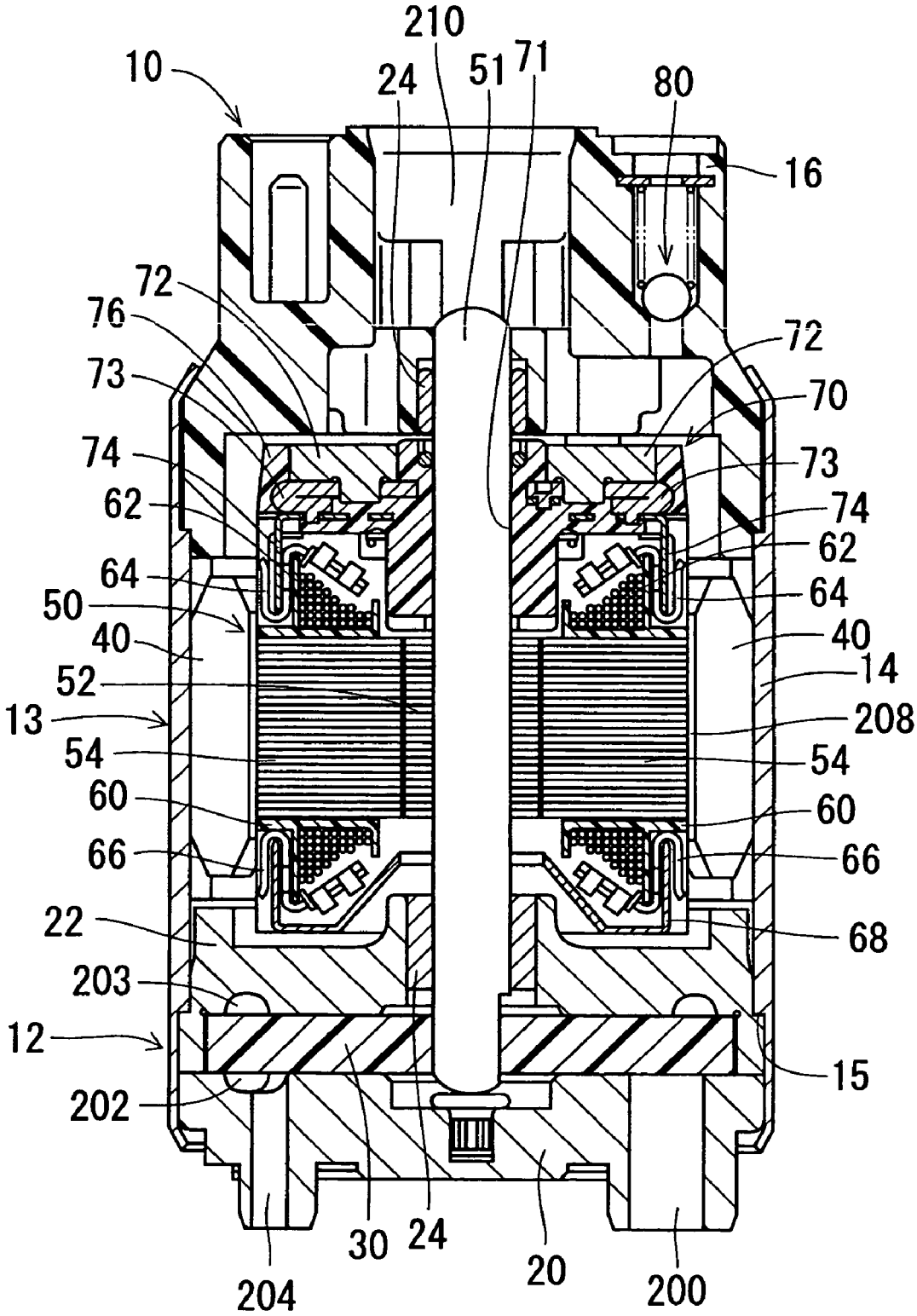
FIG. 11 is a sectional view showing a fuel pump according to a sixth embodiment.

As shown in FIG. 11, in the sixth embodiment, a fuel pump 10 is an in-tank type turbine pump that is provided to an interior of a fuel tank of a vehicle such as an automobile, similarly to the above embodiments. In this embodiment, outlet pressure of the fuel pump 10 is set between 0.25 to 1.0 MPa, for example. The fuel pump 10 discharges fuel over a range of 50 to 250 L/h, for example. Rotation speed of the fuel pump 10 is set between 4000 to 12000 rpm, for example.

The fuel pump 10 includes a pump portion 12 and a motor portion 13, similarly to the above embodiments. A housing 14 accommodates both the pump portion 12 and the motor portion 13. The housing 14 is crimped and fixed to an end cover 16 and a pump case 20.

Figure 13A:
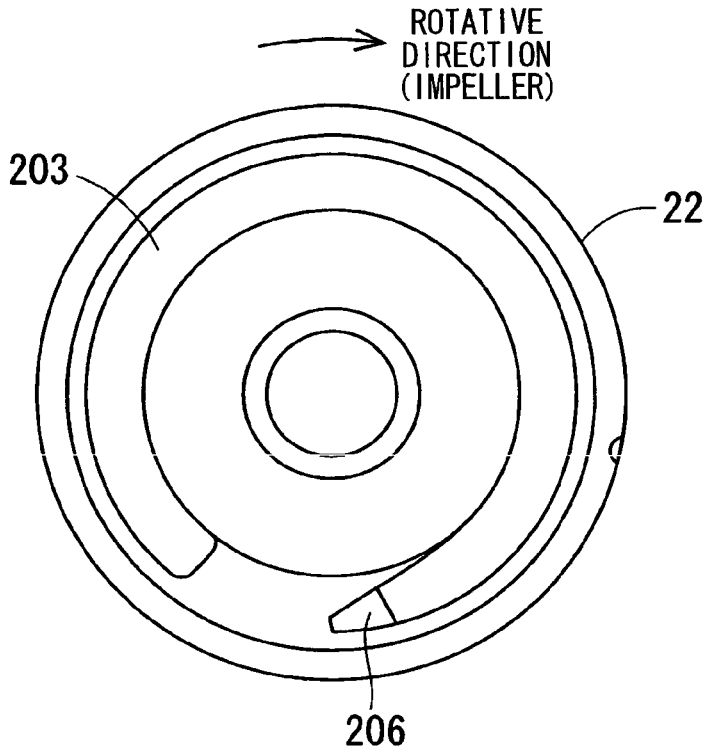
FIG. 13A is a schematic view showing a pump case of the fuel pump when being viewed from an outlet side.

The pump portion 12 is a turbine pump that includes pump cases 20, 22, and an impeller 30. The pump case 22 is press-inserted into the housing 14 axially onto the step 15 of the housing 14. The pump cases 20, 22 serve as case members rotatably accommodating the impeller 30 as a rotor member. The pump cases 20, 22 and the impeller 30 define pump passages 202, 203 (FIGS. 13A, 13B) in substantially C-shapes thereamong. In this structure, the impeller 30 has the pump passages 202, 203 respectively on both sides with respect to the axial direction, i.e., thickness direction of the impeller 30.

Figure 13B:
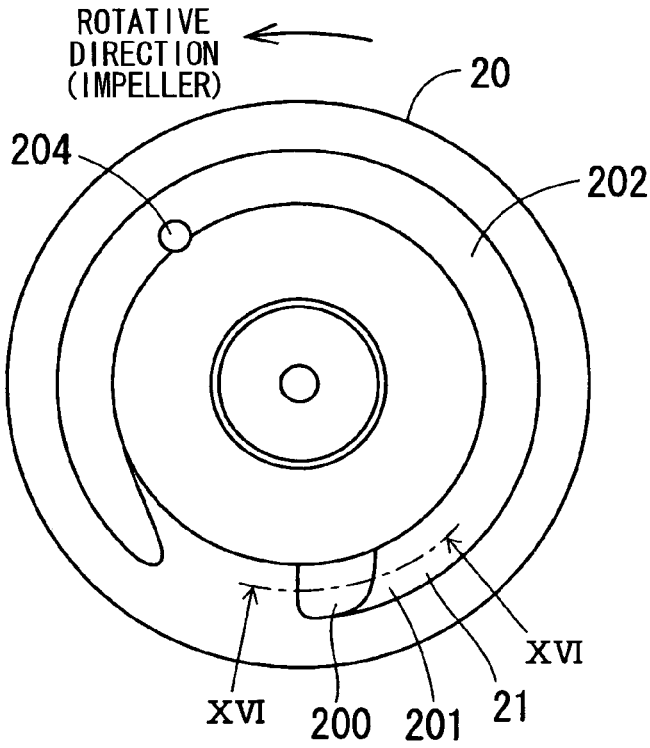
FIG. 13B is a schematic view showing the pump case when being viewed from the inlet side.
Figure 14A:
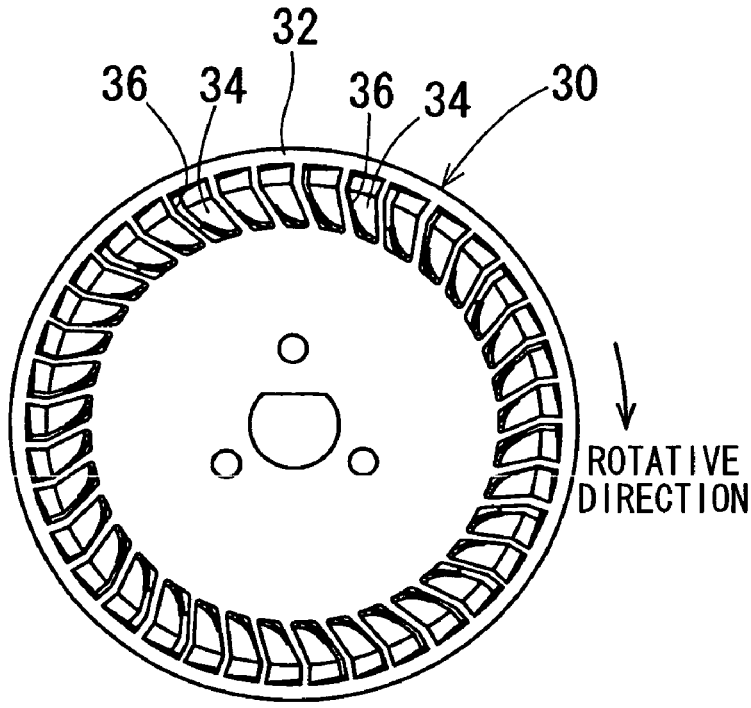
FIGS. 14A, 14B are front views showing the impeller when being viewed from the inlet side.
Figure 14B:
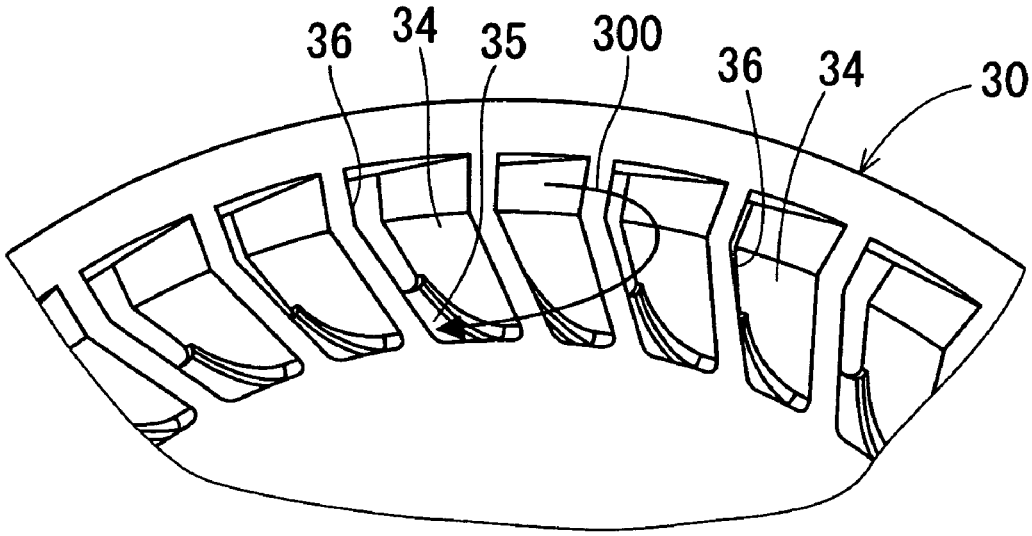

As shown in FIGS. 14A, 14B, the impeller 30 in a substantially disc-shape has the outer circumferential periphery, around which vane grooves 36 are arranged with respect to the rotative direction. The impeller 30 rotates together with the shaft 51 in conjunction with rotation of the armature 50 (FIG. 11), so that fuel flows from a radially outer side of one of the vane grooves 36 into the pump passages 202, 203. The fuel flows from the pump passages 202, 203 into a radially inner side of another vane groove 36, which is on a backside of the one of the vane grooves 36 with respect to the rotative direction. Thus, fuel forms a swirl flow 300 by repeating flowing out of the one of the vane grooves 36 and flowing into the other vane groove 36. The fuel forming the swirl flow 300 is pressurized through the pump passages 202, 203. Fuel is drawn through the inlet port 200 (FIG. 13B), which is provided to the pump case 20, by rotation of the impeller 30. The drawn fuel is pressurized through the pump passages 202, 203, which are on both sides of the impeller 30 with respect to the thickness direction of the impeller 30, by rotation of the impeller 30. The pressurized fuel is press-fed toward the motor portion 13 through the outlet port 206 (FIG. 13A), which is provided to the pump case 22. Fuel is pressurized through the pump passage 202 on the side of the inlet port 200. This pressurized fuel flows into the pump passage 203 on the side of the outlet port 206 through the vane groove 36 in the vicinity of the outlet port 206. Thus, the fuel is press-fed from the outlet port 206 into the motor portion 13. The fuel press-fed toward the motor portion 13 is supplied to the engine through the outlet port 210, which is provided to the end cover 16, after passing through the fuel passage 208 defined between the permanent magnet 40 and the armature 50. The pump case 20 has a vent hole 204 (FIG. 13B). Vapor contained in fuel flowing through the pump passages 202, 203 is exhausted to the outside of the fuel pump 10 through the vent hole 204.

Each of the permanent magnets 40 is in a substantially quadrant arch shape. Four permanent magnets 40 are circumferentially arranged along the inner circumferential periphery of the housing 14. The permanent magnets 40 define four magnetic poles, which are different from each other with respect to the rotative direction of the impeller 30.

The armature 50 has the end, which is on the side of the impeller 30, being covered with a metallic cover 68, so that resistance against rotation of the armature 50 is reduced. The armature 50 has the other end, which on the opposite side of the impeller 30. The other end of the armature 50 is provided with the commutator 70. The shaft 51 serves as the rotation axis of the armature 50. The shaft 51 is rotatably supported by bearings 24, which are accommodated by the end cover 16 and the pump case 22. In this embodiment, the six coil terminals 66 electrically connect with each other via the metallic cover 68.

Next, the structures of the impeller 30 and the inlet port 200 are described.

Figure 12A:
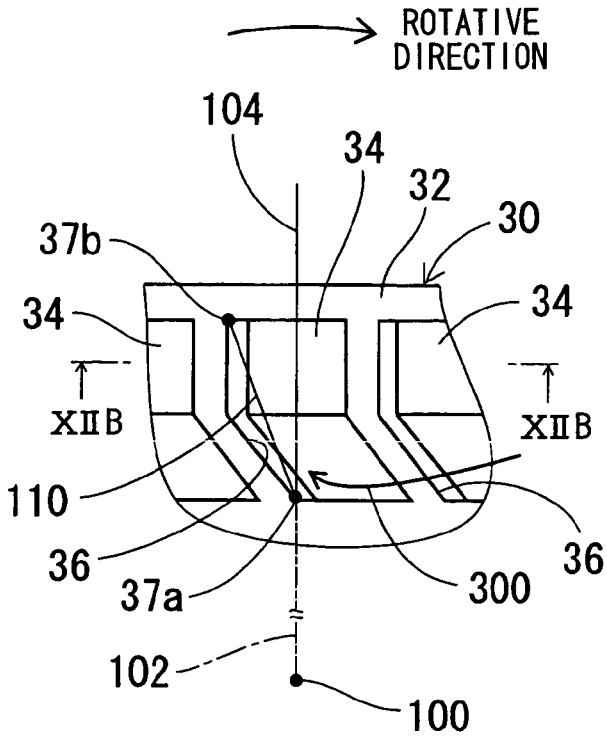
FIG. 12A is a schematic view showing vane grooves of an impeller of the fuel pump when being viewed from an inlet side.
Figure 12B:
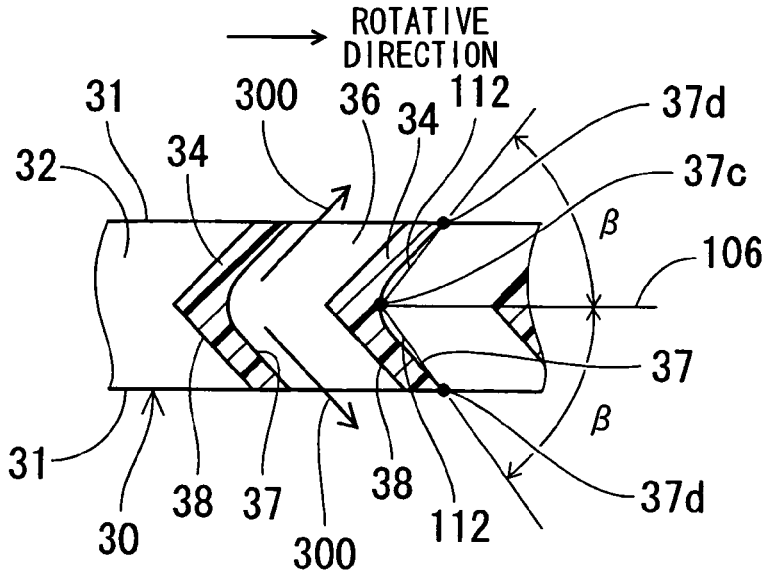
FIG. 12B is a sectional view taken along the line XIIB-XIIB in FIG. 12A.
Figure 15:
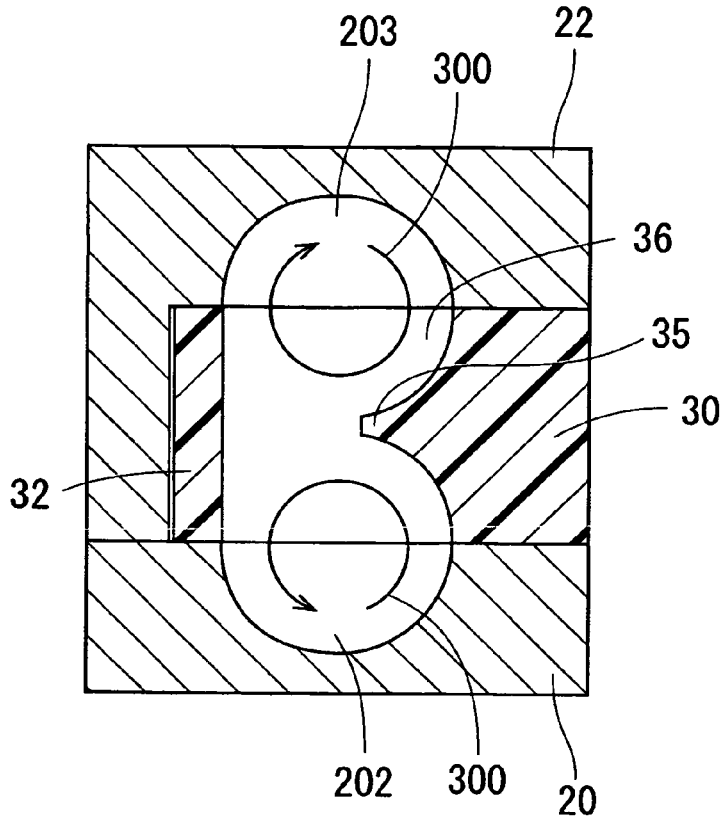
FIG. 15 is a sectional view showing a pump passage of the fuel pump.

The impeller 30 is integrally formed of resin to be in a substantially disc-shape. As shown in FIGS. 14A, 14B, the impeller 30 has the outer circumferential periphery that is surrounded by the annular portion 32. The annular portion 32 has the inner circumferential periphery, to which vane grooves 36 are arranged with respect to the rotative direction. The vane grooves 36, which are circumferentially adjacent to each other, are nonuniformly spaced. The vane grooves 36 may be arranged at irregular pitch with respect to the rotative direction. As shown in FIG. 12B, the vane grooves 36, which are adjacent to each other with respect to the rotative direction, are partitioned by the partition wall 34. The impeller 30 has the thickness-center 37*c* with respect to the thickness direction of the impeller 30. The impeller 30 has the thickness-end surfaces 31 with respect to the thickness direction of the impeller 30. The partition wall 34 extends substantially from the thickness-center 37*c* of the impeller 30 toward both the thickness-end surfaces 31. The partition wall 34 is inclined forwardly with respect of the rotative direction such that the partition wall 34 forms a substantially V-shape. As shown in FIG. 15, the partition wall 35 radially outwardly protrudes from the radially inner side of the vane groove 36. The partition wall 35 partially partitions the radially inner side of the vane groove 36. The vane groove 36 communicates with each other with respect to the axial direction of the rotation axis on the radially outer side of the partition wall 35. Fuel flows from the pump passages 202, 203 on the axially both sides into the vane grooves 36, and the fuel forms the swirl flow 300 that oppositely rotates on axially both sides along the partition wall 35.

As shown in FIG. 12B, the vane groove 36 has the back surface 37 on the backside, i.e., rear side with respect to the rotative direction. As referred to FIG. 12A, at least the radially inner side of the back surface 37 is inclined from the radially inner side to the radially outer side backwardly with respect to the rotative direction. That is, at least the radially inner side of the back surface 37 on the lower side in FIG. 12A is inclined from the lower side to the upper side in FIG. 12A toward the left side in FIG. 12A. The back surface 37 of the vane groove 36 has the radially inner end 37*a* and the radially outer end 37*b*, which are connected via the line segment 110. The straight line 104 extends radially outwardly from the radially inner end 37*a* along the radius 102 of the impeller 30. The line segment 110 is inclined relative to the straight line 104 backwardly with respect to the rotative direction on the radially outer side. In FIG. 12A, the reference numeral 100 denotes the rotation axis of the impeller 30.

As referred to FIG. 12B, the back surface 37 is inclined forwardly with respect to the rotative direction from the thickness-center 37*c* toward both the thickness-end surfaces 31. That is, the back surface 37 extends from the thickness-center 37*c* toward both the thickness-end surfaces 31 such that the back surface 37 forms a substantially V-shape. The back surface 37 has the thickness-ends 37*d* with respect to the thickness direction of the impeller 30. The thickness-center 37*c* and each of the thickness-ends 37*d* are connected via the line segment 112. The straight line 106 extends from the thickness-center 37*c* along the circumferential direction forwardly with respect to the rotative direction. The line segment 112 and the straight line 106 define a forward inclining angle β therebetween. In this embodiment, the forward inclining angle β satisfies the following relationship: $40° \leqq \beta \leqq 60°$. The straight line 106 is perpendicular to the rotation axis 100.

Figure 16:
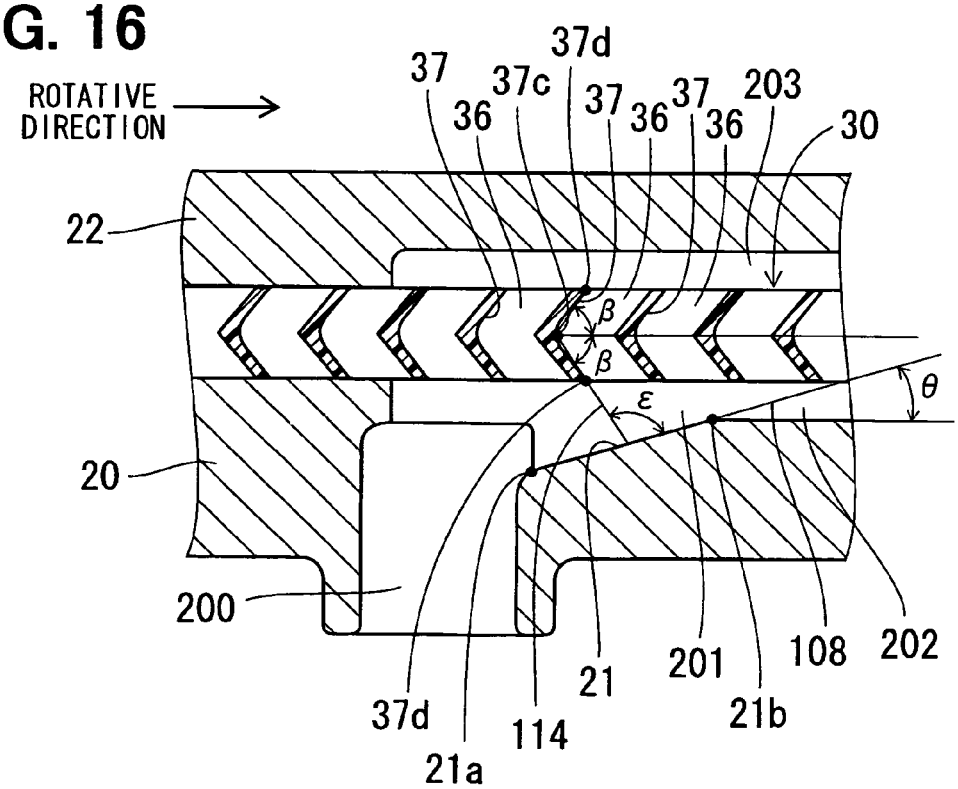
FIG. 16 is a sectional view showing the impeller and the pump case taken along the line XVI-XVI in FIG. 13B.

As referred to FIG. 16, the inlet port 200 communicates with the pump passages 202 through a communication passage 201. The communication passage 201 has a cross section that gradually decreases from the inlet port 200 toward the pump passages 202. The communication passage 201, which communicates the inlet port 200 with the pump passages 202, has a communication wall 21. The communication wall 21 gradually is elevated from the inlet port 200 toward the pump passages 202, and connects with the pump passages 202. Fuel is drawn through the inlet port 200, and is introduced toward the vane grooves 36 along the communication wall 21.

The communication wall 21 has an inlet-side end 21*a* and a passage-side end 21*b*, which are connected via an inclining straight line 108. A line segment 114 extends from the thickness-center 37*c* to the inclining straight line 108 through one of the thickness-ends 37*d*. The inclining straight line 108 and the line segment 114 define an angle ϵ forwardly with respect to the rotative direction. The angle ϵ satisfies the following relationship: $90° \leqq \epsilon \leqq 130°$.

Figure 17:
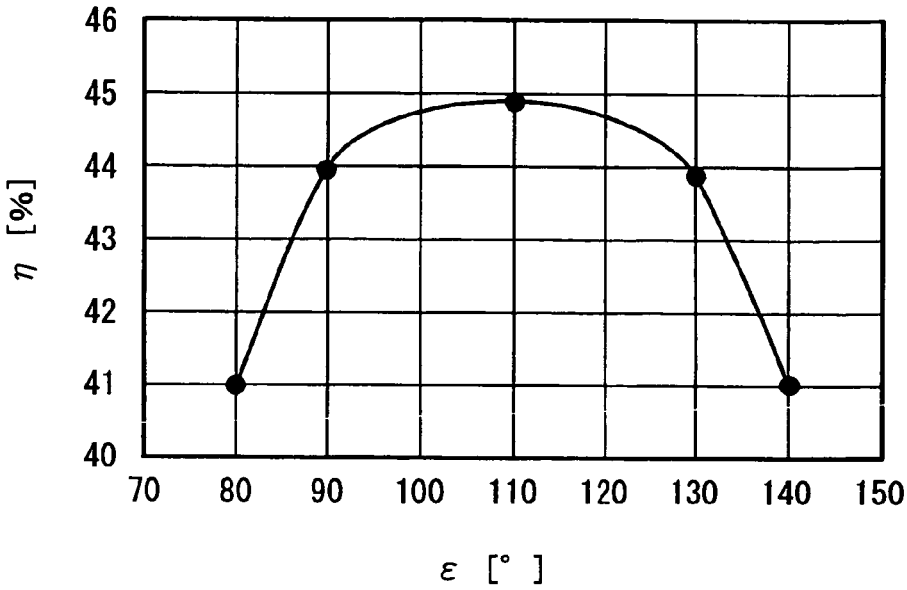
FIG. 17 is a graph showing a relationship between an angle $\epsilon$ in FIG. 16 and the pump efficiency.

Fuel flowing through the inlet port 200 is introduced along the communication wall 21. The fuel flows into the vane grooves 36 of the impeller 30, which rotates at generally high speed. When the angle ϵ is less than 90°, i.e., $\epsilon < 90°$, the fuel flowing into the vane grooves 36 may collide against the back surface 37 of the vane groove 36 at a large angle. When the angle ϵ is greater than 130°, i.e., $\epsilon > 130°$, the back surface 37 of the vane groove 36 becomes largely distant from the fuel, which flows into the vane grooves 36 through the inlet port 200 by being introduced along the communication wall 21. Accordingly, the fuel is hard to flow into the vane grooves 36. Therefore, in this structure, the angle ϵ is defined to satisfy the relationship of $90° \leqq \epsilon \leqq 130°$, so that fuel smoothly flows into the vane grooves 36 along the back surface 37 while the impeller rotates at high speed. Thus, as shown in FIG. 17, the pump efficiency ηp of the pump portion 12 is significantly enhanced in the range of $90° \leqq \epsilon \leqq 130°$.

The communication wall 21, which extends from the inlet port 200 toward the pump passages 202, is elevated at rising angle θ. That is, the inclining straight line 108, which extends from the inlet port 200 toward the pump passages 202, is elevated at the rising angle θ. The rising angle θ satisfies the following relationship: $10° \leqq \theta \leqq 30°$.

When the rising angle θ is less than 10°, i.e., $10° > \theta$, fuel, which flows from the inlet port 200 toward the communication wall 21, is peeled around the corner between the inlet port 200 and the communication wall 21. That is, the fuel flow is peeled from the communication wall 21 around the inlet-side end 21*a*. Consequently, the fuel flow loses energy. When the rising angle θ is greater than 30°, i.e., $\theta > 30°$, the cross sectional area of the communication passage 201 becomes large around the inlet-side end 21*a*. In this case, fuel flow passing from the inlet port 200 toward the communication wall 21 may not be entirely oriented toward the pump passages 202, and may partially accumulate. Consequently, the fuel flow loses energy. Thus, the pump efficiency ηp decreases due to reduction in energy of fuel flow. Therefore, in this structure, the rising angle θ is set to satisfy the relationship of $10° \leqq \theta \leqq 30°$, so that fuel flow passing from the inlet port 200 toward the communication wall 21 can be restricted from peeling from the communication wall 21, and can be restricted from accumulating around the inlet-side end 21*a*. Thus, energy of fuel flow can be maintained, so that the pump efficiency ηp can be enhanced.

When the forward inclining angle β is less than 40°, i.e., $\beta < 40°$, the direction of the swirl flow 300 entering into the vane grooves 36 is drastically changed forwardly with respect to the rotative direction, and the swirl flow 300 exits from the vane grooves 36. Consequently, energy of the swirl flow 300 is reduced.

In this structure, the forward inclining angle β satisfies the relationship of $40° \leqq \beta$, so that energy of the swirl flow 300 passing from the vane grooves 36 is maintained.

When the swirl flow 300 moves out of the vane groove 36, the swirl flow 300 receives a component of energy from the vane groove 36 forwardly with respect to the rotative direction. When the forward inclining angle β is set to be greater than 60°, i.e., $\beta > 60°$, the component of energy forwardly applied from the vane groove 36 to the swirl flow 300 becomes small. Accordingly, a pitch of the swirl flow 300 with respect to the rotative direction becomes large. Consequently, when the swirl flow 300 moves out of one vane groove 36 and enters into subsequent vane groove 36, which is on the backside of the one vane groove 36 with respect to the rotative direction, the interval between the one vane groove 36 and the subsequent vane groove 36 becomes large. Consequently, when the forward inclining angle β is set to be greater than 60°, the number of entrance into and exit from the vane grooves 36 decreases while the swirl flow 300 passes through the pump passages 202. Accordingly, fuel cannot be sufficiently pressurized.

Therefore, in the sixth embodiment, the forward inclining angle β is set to satisfy the relationship of $\beta \leqq 60°$, so that the component of energy, which is applied from the vane groove 36 to the swirl flow 300 forwardly with respect to the rotative direction when the swirl flow 300 moves out of the vane groove 36, becomes large. Thus, the pitch of the swirl flow 300 with respect to the rotative direction becomes small. Consequently, the number of entrance into and exit from the vane grooves 36 increases while the swirl flow 300 passes through the pump passages 202. Therefore, efficiency of pressurizing fuel can be enhanced, so that the pump efficiency ηp can be enhanced.

In addition, in this embodiment, the vane groove 36 has the front surface 38 on the front side with respect to the rotative direction. The front surface 38 extends from the thickness-center 37*c* toward both the thickness-end surfaces 31 such that the front surface 38 forms a substantially V-shape, similarly to the back surface 37. In this structure, the shape of the back surface 37 and the shape of the front surface 38 are substantially the same, so that a flow amount of fuel flowing out of the vane groove 36 and a flow amount of the fuel flowing into the vane groove 36 are substantially uniformed. Consequently, efficiency of pressurizing fuel can be enhanced, so that the pump efficiency ηp can be enhanced.

In addition, in this embodiment, the annular portion 32 surrounds the radially outer side of the vane grooves 36, and the outer circumferential periphery of the impeller 30 does not have a pump passage. Fuel is pressurized through the pump passages 202, and the pressurized fuel generates differential pressure with respect to the rotative direction. In this structure of this embodiment, the differential pressure is not directly applied radially to the impeller 30. Thus, force applied to the impeller 30 with respect to the radial direction is reduced. Consequently, the rotation center of the impeller 30 can be restricted from being misaligned, so that the impeller 30 can smoothly rotate.

Thus, the pump efficiency ηp is enhanced, so that the capacity of the fuel pump 10 can be enhanced, and the discharge amount of the fuel pump 10 can be also enhanced.

(Modification)

Figure 18:
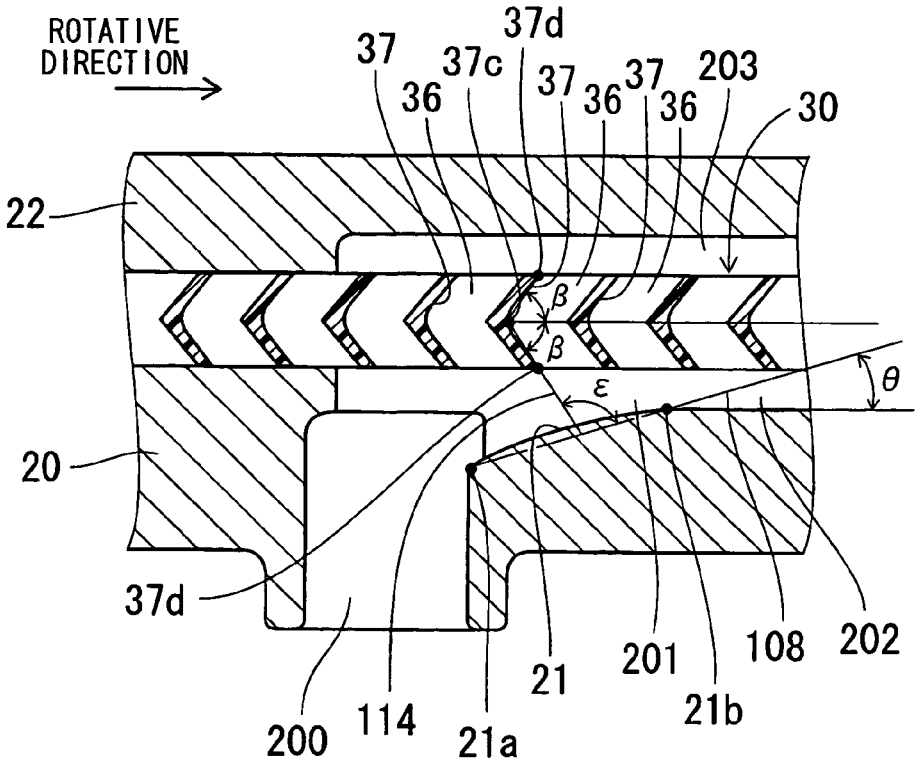
FIG. 18 is a sectional view showing the impeller and a pump case according to a modification.

The communication wall 21 is not limited to a flat surface. As shown in FIG. 18, the communication wall 21 may be in a substantially convex surface. The communication wall 21 shown in FIG. 18 is gradually elevated from the inlet port 200 toward the pump passages 202, and communicates with the pump passages 202. In this structure, fuel is drawn through the inlet port 200, and is introduced by the communication wall 21 toward the vane grooves 36. In this modification, the angle ϵ is defined to satisfy the relationship of $90° \leqq \epsilon \leqq 130°$.

Summarizing the above embodiments, the impeller 30 is rotatable in the fluid pump 10 having the pump passage 202, 203 extending along the rotative direction of the impeller 30. The impeller 30 includes the partition walls 34 that are arranged along the rotative direction. Adjacent two of the partition walls 34 define the vane groove 36 therebetween. Each partition wall 34 has the back surface 37 on the backside with respect to the rotative direction. At least the radially inner side of the back surface 37 is radially outwardly inclined backwardly with respect to the rotative direction. The back surface 37 has the radially inner end 37*a*, 121*a*, 131*a*, 141*a*, 151*a* and the radially outer end 37*b*, 121*b*, 131*b*, 141*b*, 151*b*, which are connected via the line segment 110. The line segment 110 may define the backward inclining angle α with respect to the radius 102 of the impeller 30. The backward inclining angle α may be an acute angle. The back surface 37 is inclined from the thickness-center 37*c* of the impeller 30 toward both thickness-ends 37*d* of the impeller 30 forwardly with respect to the rotative direction. The thickness-center 37*c* and each of the thickness-ends 37*d* are connected via the line segment 112. The line segment 112 may define the forward inclining angle β with respect to the straight line 106. The forward inclining angle β may be an acute angle. The straight line 106 may be tangent to the circumscribed circle of the outer circumferential periphery of the impeller 30. The backward inclining angle α and the forward inclining angle β preferably satisfy the following relationships: $15° \leqq \alpha \leqq 30°$; $\beta \leqq 60°$; and $1 \leqq \beta/\alpha \leqq 4$.

Alternatively, the fluid pump 10 includes the case member 20, 22 and the impeller 30. The case member 20, 22 has the inlet port 200 and the pump passage 202, 203. The impeller 30 is rotatable in the case member 20, 22. The impeller 30 having the vane grooves 36 along the pump passage 202, 203 extending along the rotative direction of the impeller 30. Each vane groove 36 is defined by the back surface 37 on the backside with respect to the rotative direction. At least the radially inner side of the back surface 37 is outwardly inclined backwardly with respect to the rotative direction. The back surface 37 has the radially inner end 37*a*, 121*a*, 131*a*, 141*a*, 151*a* and the radially outer end 37*b*, 121*b*, 131*b*, 141*b*, 151*b*, which are connected via the line segment (first line segment) 110. The first line segment 110 may define the backward inclining angle α with respect to the radius 102 of the impeller 30. The backward inclining angle α may be an acute angle. The back surface 37 on the side of the inlet port 200 is inclined from the thickness-center 37*c* of the impeller 30 toward the inlet port 200 forwardly with respect to the rotative direction. The case member 20, 22 has the communication wall 21 that defines the communication passage 201 communicating the inlet port 200 with the pump passage 202, 203. The communication wall 21 has the inlet-side end 21*a* and the passage-side end 21*b* that are connected via the inclining straight line 108, which is gradually elevated from the inlet port 200 toward the pump passage 202, 203. The inclining straight line 108 may define the angle ϵ with respect to the line segment (second line segment) 114, which extends from the thickness-center 37*c* of the back surface 37 to the inclining straight line 108 through the inlet-side end 21*a* of the back surface 37. The angle ϵ may be one of the right angle and the obtuse angle. The angle ϵ preferably satisfies the following relationship: $90° \leqq \epsilon \leqq 130°$.

Other Embodiment

The rising angle θ may be preferably set to satisfy the relationship of $10° \leqq \theta \leqq 30°$. However, the rising angle θ is not limited to this range of $10° \leqq \theta \leqq 30°$.

In the above embodiments, the back surface 37 is inclined from the thickness-center 37*c* to each of the thickness-ends 37*d* at the inclining angle β such that the forward inclining angle β satisfies the following relationship: $40° \leqq \beta \leqq 60°$. Alternatively, the back surface 37 may be inclined from the thickness-center 37*c* to one of the thickness-ends 37*d* on the side of the inlet port 200 such that the forward inclining angle β satisfies the following relationship: $40° \leqq \beta \leqq 60°$. The inclining angle β may be preferably set to satisfy the relationship of $40° \leqq \beta \leqq 60°$. However, the inclining angle β is not limited to this range of $40° \leqq \beta \leqq 60°$.

In the above embodiments, fuel is pressurized through both the pump passages 202, 203 on both sides of the impeller 30. Subsequently, the fuel is drawn through the inlet port 200 on one side of the impeller 30 with respect to the thickness direction, and the drawn fuel is press-fed to the other side of the impeller 30. Thus, fuel is supplied toward the motor portion 13. Alternatively, for example, the fuel pump may have a structure in which pressurized fuel is not press-fed into the motor portion 13. In this structure, the pump passage 203, which is on the opposite side of the inlet port 200 with respect to the impeller 30, may be omitted, and fuel may be pressurized through the pump passage 202 on the side of the inlet port 200.

The communication wall 21 is not limited to be in a substantially flat surface and a substantially convex surface. The communication wall 21 may be in a substantially concaved surface.

The outer circumferential periphery of the vane grooves 36 may not be surrounded by the annular portion 32, and the outer circumferential periphery of the vane grooves 36 may be opened. In the above embodiments, the front surface 38 of the vane groove 36 extends correspondingly to the back surface 37 such that the front surface 38 forms a substantially V-shape. Alternatively, the front surface 38 may be a substantially flat surface extending generally along the thickness direction.

In the above embodiments, the motor having the brush is applied to the motor portion of the fuel pump. Alternatively, a brushless motor may be applied to the motor portion.

Fluid is not limited to fuel the structure of the pump and the impeller may be applied to any other hydraulic apparatuses.

The above structures of the embodiments can be combined as appropriate.

Various modifications and alternations may be diversely made to the above embodiments without departing from the spirit of the present invention.

What is claimed is:

1. An impeller, which is rotatable in a fluid pump to pressurize fluid in a pump passage along a rotative direction of the impeller, the impeller comprising:

a plurality of partition walls that is arranged along the rotative direction, adjacent two of the plurality of partition walls defining a vane groove therebetween, wherein each partition wall has a back surface on a backside with respect to the rotative direction, the back surface having a radially inner side, at least the radially inner side of the back surface is radially outwardly inclined backwardly with respect to the rotative direction, the back surface has a radially inner end and a radially outer end, which are connected via a first line segment, the first line segment and a first straight line, which extends radially outwardly from the radially inner end along a radius of the impeller, define a backward inclining angle $\alpha$ therebetween, the impeller has a thickness-center and thickness-ends with respect to a thickness direction of the impeller, the back surface is inclined from the thickness-center toward both the thickness-ends forwardly with respect to the rotative direction, the thickness-center and each of the thickness-ends are connected via a second line segment, the second line segment and a second straight line, which extends from the thickness-center along the circumferential direction forwardly with respect of the rotative direction, define a forward inclining angle $\beta$ therebetween, and the backward inclining angle $\alpha$ and the forward inclining angle $\beta$ satisfy the following relationships: $15° \leqq \alpha \leqq 30°$; $\beta \leqq 60°$; and $1 \leqq \beta/\alpha \leqq 4$.

2. The impeller according to claim 1, wherein the backward inclining angle $\alpha$ satisfies the following relationship: $20° \leqq \alpha$.

3. A fluid pump comprising:

a motor portion;

the impeller according to claim 1, the impeller being rotated by the motor portion; and a case member that defines the pump passage, the impeller being rotatable in the case member.

4. A fluid pump comprising:

a case member that has an inlet port and a pump passage; and an impeller that is rotatable in the case member, the impeller having a plurality of vane grooves along the pump passage extending along a rotative direction of the impeller, each vane groove defined by a back surface on a backside with respect to the rotative direction, wherein at least a radially inner side of the back surface is inclined to a radially outer side backwardly with respect to the rotative direction, the back surface has a radially inner end and a radially outer end, which are connected via a first line segment, the first line segment is inclined relative to a straight line, which extends radially outwardly from the radially inner end along a radius of the impeller, backwardly with respect to the rotative direction, the impeller has a thickness-center with respect to a thickness direction of the impeller, at least an inlet side of the back surface on a side of the inlet port is inclined from the thickness-center toward the inlet port with respect to the thickness direction forwardly with respect to the rotative direction, the case member has a communication wall that defines a communication passage communicating the inlet port with the pump passage, the communication wall has an inlet-side end and a passage-side end that are connected via an inclining straight line, which is gradually elevated from the inlet port toward the pump passage, the inclining straight line and a second line segment, which extends from the thickness-center of the back surface to the inclining straight line through the inlet-side end of the back surface, define an angle $\epsilon$ forwardly with respect to the rotative direction, and the angle $\epsilon$ satisfies the following relationship: $90° \leqq \epsilon \leqq 130°$.

5. The fluid pump according to claim 4, wherein the back surface is inclined from the thickness-center toward both sides with respect to the thickness direction forwardly with respect to the rotative direction.

6. The fluid pump according to claim 4, wherein the inclining straight line, which extends from the inlet-side end toward the passage-side end, is elevated at a rising angle $\theta$, and the rising angle $\theta$ satisfies the following relationship: $10° \leqq \theta \leqq 30°$.

7. The fluid pump according to claim 4, wherein the back surface defines an inclining surface that is inclined from the thickness-center toward the thickness-ends forwardly with respect to the rotative direction, the thickness-center connects with the thickness-ends via a third line segment in the inclining surface, the third line segment and a straight line, which extends from the thickness-center along a circumferential direction forwardly with respect of the rotative direction, define a forward inclining angle $\beta$ therebetween, and the forward inclining angle $\beta$ satisfies the following relationship: $40° \leqq \beta \leqq 60°$.

8. The fluid pump according to claim 4, further comprising:

a motor portion that rotates the impeller for pressurizing fluid drawn from the inlet port into the pump passage that is defined along the plurality of vane grooves.

9. A fluid pump comprising:

a case member that defines a pump passage therein; and an impeller, which is rotatable in case member to pressurize fluid in the pump passage along a rotative direction of the impeller, wherein the impeller includes a plurality of partition walls along the rotative direction, adjacent two of the plurality of partition walls defining a vane groove therebetween, each partition wall has a back surface on a backside with respect to the rotative direction, at least a radially inner side of the back surface is radially outwardly inclined backwardly with respect to the rotative direction, the back surface has a radially inner end and a radially outer end, which are connected via a first line segment, the first line segment and a first straight line, which extends radially outwardly from the radially inner end along a radius of the impeller, define a backward inclining angle $\alpha$ therebetween, the impeller has a thickness-center and thickness-ends with respect to a thickness direction of the impeller, the back surface is inclined from the thickness-center toward both the thickness-ends forwardly with respect to the rotative direction, the thickness-center and each of the thickness-ends are connected via a second line segment, the second line segment and a second straight line, which extends from the thickness-center along the circumferential direction forwardly with respect of the rotative direction, define a forward inclining angle $\beta$ therebetween, and the backward inclining angle $\alpha$ and the forward inclining angle $\beta$ satisfy the following relationships: $15° \leqq \alpha \leqq 30°$; $\beta \leqq 60°$; and $1 \leqq \beta/\alpha \leqq 4$.

10. An impeller, which is rotatable in a fluid pump having a pump passage extending along a rotative direction of the impeller, the impeller comprising:

a plurality of partition walls that is arranged along the rotative direction, adjacent two of the plurality of partition walls defining a vane groove therebetween, wherein each partition wall has a back surface on a backside with respect to the rotative direction, at least a radially inner side of the back surface is radially outwardly inclined backwardly with respect to the rotative direction, the back surface has a radially inner end and a radially outer end, which are connected via a first line segment defining a backward inclining angle $\alpha$ being an acute angle with respect to a radius of the impeller, the back surface is inclined from a thickness-center of the impeller toward both thickness-ends of the impeller forwardly with respect to the rotative direction, the thickness-center and each of the thickness-ends are connected via a second line segment, which defines a forward inclining angle $\beta$ being an acute angle with respect to a first straight line, which is tangent to a circumscribed circle of an outer circumferential periphery of the impeller, and the backward inclining angle $\alpha$ and the forward inclining angle $\beta$ satisfy the following relationships: $15° \leqq \alpha \leqq 30°$; $\beta \leqq 60°$; and $1 \leqq \beta/\alpha \leqq 4$.

11. A fluid pump comprising:

a case member that has an inlet port and a pump passage; and an impeller that is rotatable in the case member, the impeller having a plurality of vane grooves along the pump passage extending along a rotative direction of the impeller, each vane groove being defined by a back surface on a backside with respect to the rotative direction, at least a radially inner side of the back surface is outwardly inclined backwardly with respect to the rotative direction, the back surface has a radially inner end and a radially outer end, which are connected via a first line segment, which defines a backward inclining angle $\alpha$ being an acute angle with respect to a radius of the impeller, the back surface on a side of the inlet port is inclined from a thickness-center of the impeller toward the inlet port forwardly with respect to the rotative direction, the case member has a communication wall that defines a communication passage communicating the inlet port with the pump passage, the communication wall has an inlet-side end and a passage-side end that are connected via an inclining straight line, which is gradually elevated from the inlet port toward the pump passage, the inclining straight line defines an angle $\epsilon$ being one of a right angle and an obtuse angle with respect to a second line segment, which extends from the thickness-center of the back surface to the inclining straight line through the inlet-side end of the back surface, and the angle $\epsilon$ satisfies the following relationship: $90° \leqq \epsilon \leqq 130°$.

* * * * *